US005189631A

United States Patent [19]

Suzuki

[11] Patent Number: 5,189,631

[45] Date of Patent: Feb. 23, 1993

[54] SMOKE DENSITY MONITOR SYSTEM

[75] Inventor: Takashi Suzuki, Tokyo, Japan

[73] Assignee: Nittan Company, Limited, Tokyo, Japan

[21] Appl. No.: 623,089

[22] Filed: Dec. 6, 1990

[30] Foreign Application Priority Data

Dec. 19, 1989 [JP] Japan ..... 1-327163

[51] Int. Cl.[5] ..... G08B 17/107

[52] U.S. Cl. ..... 364/550; 340/630

[58] Field of Search ..... 250/553, 573; 340/630; 356/434, 436; 364/550

[56] References Cited

U.S. PATENT DOCUMENTS 3,919,702 11/1975 Hayes et al. ..... 340/630 X
4,131,888 12/1978 Galvin ..... 340/630
4,763,903 8/1988 Goodwin et al. ..... 250/553 X
4,972,178 11/1990 Suzuki ..... 340/577
4,977,527 12/1990 Shaw et al. ..... 364/550

*Primary Examiner*—Edward R. Cosimano
*Attorney, Agent, or Firm*—Stevens, Davis, Miller & Mosher

[57] ABSTRACT

A smoke density monitor system comprises an imaginarily dividing a space to be monitored two-dimensionally into a plurality of imaginary subspaces so that plural paths passing through a plurality of arbitrary subspaces are arranged to intersect each other; measuring the transmittance of light along each path; calculating a transmittance of light at each imaginary subspace using a mathematical method in which the measured result of the transmittance of the each path are placed into matrices and the solution to an equation involving the matrices is carried out with matrices; and determining a smoke density at each of the imaginary subspace on the basis of the transmittance at each subspaces.

11 Claims, 2 Drawing Sheets

SMOKE DENSITY MONITOR SYSTEM

RELATED INVENTIONS

This invention is related to applicant's prior U.S. Pat. No. 4,972,178 issued Nov. 20, 1990 titled "FIRE MONITORING SYSTEM".

BACKGROUND OF THE INVENTION

This invention relates to systems for monitoring smoke density in a monitored space.

Systems for monitoring smoke density covering an extensive monitored space have been heretofore proposed and applied to detect fires and the like. A system for detecting the smoke density based on the transmittance of light radiated from a light source, allowing a comparatively large monitored space to be covered, is popular and widely used. One specific application of this system is an attenuation type smoke detector employed in, e.g., fire detecting equipment. The smoke detector is such that a light source is arranged so as to confront a light detector with a monitored space interposed therebetween so that the transmittance of light reaching the light detector from the light source is monitored and that the monitored transmittance is compared with a predetermined value to obtain a smoke detection signal.

In the case where the smoke density of the monitored space is monitored by the transmittance of light, it is advantageously that one set of devices permit monitoring an extensive space in one direction.

However, when the space to be monitored is too long, it becomes difficult to accurately detect a local rise of smoke density, and hence to locate a fire or the like. Assuming that a monitored space extending linearly from the light source to the photo detector is a collection of imaginary subspaces, only the accumulated value of the transmittances of each subspaces is obtained as a result of detection.

SUMMARY OF THE INVENTION

Accordingly, an object of the present invention is to overcome the above disadvantage.

The smoke density monitor system according to the present invention comprises the steps of: imaginarily dividing a space to be monitored two-dimensionally into a plurality of imaginary subspaces so that plural paths passing through a plurality of arbitrary subspaces are arranged to intersect each other; measuring the transmittance of light along each path; calculating a transmittance of light at each imaginary subspace using a mathematical method in which the measured result of the transmittance along each path is placed into matrices and the solution to an equation involving the matrices is carried out with matrices; and determining a smoke density at each of the imaginary subspace on the basis of the transmittance at each subspace. Therefore, the smoke density monitor system detects any rise in local smoke density in a longitudinally and latitudinally large monitored space.

DETAILED DESCRIPTION OF THE PREFERRED EMBODIMENT

The smoke density monitoring system of the invention will now be described with reference to the accompanying drawings.

Figure 1:
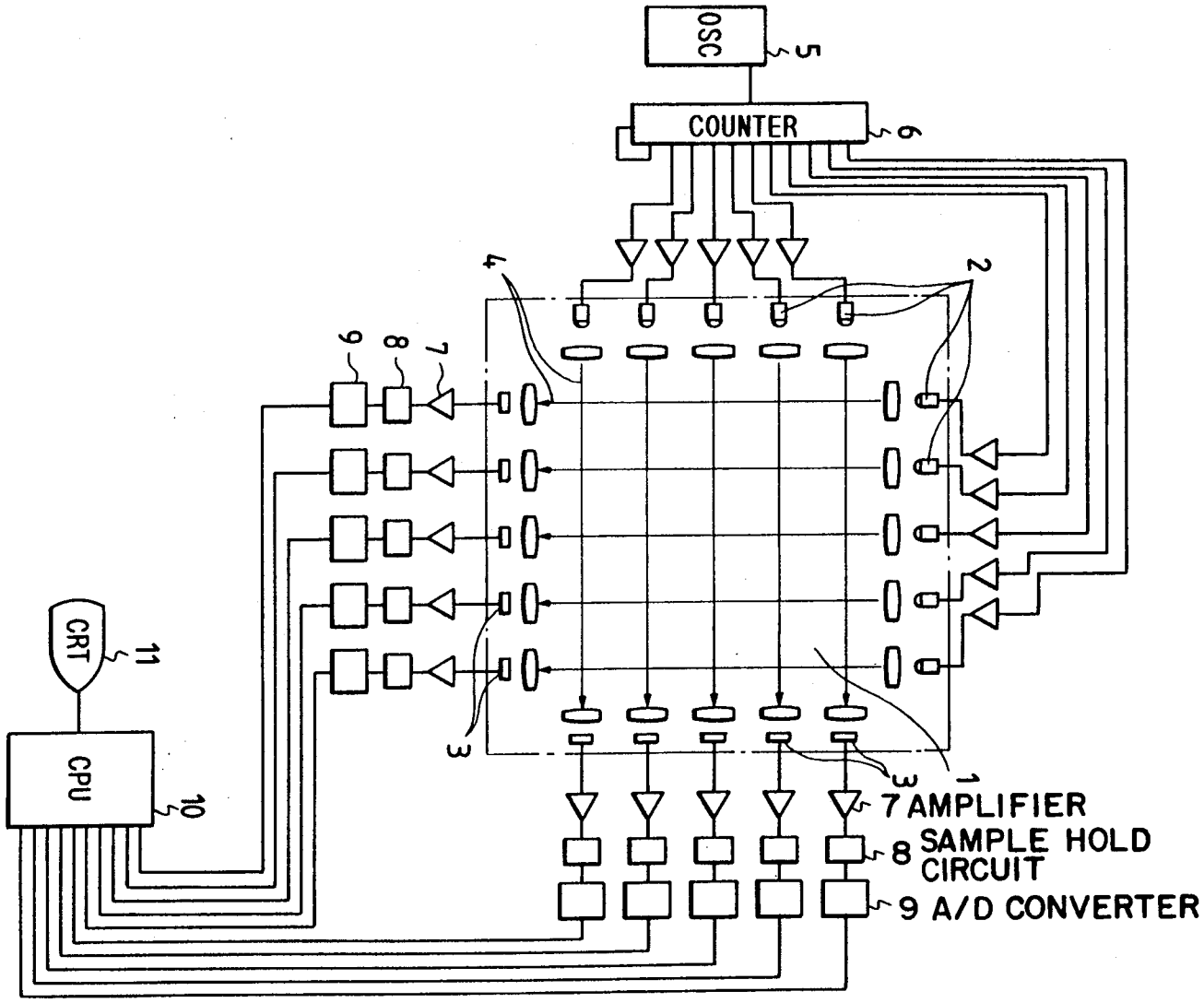
FIG. 1 is a diagram showing the main portion of an exemplary embodiment of a smoke density monitor using a smoke density monitoring system of the invention.

FIG. 1 is a diagram showing the main portion of an exemplary embodiment of smoke density monitoring device to which the smoke density monitoring system of the invention is applied. A plurality of pairs, each consisting of first and second groups of light sources 2 respectively along the left and upper sides of space 1 and first and second groups of light detectors 3, respectively along the right and lower sides of space 1 and having a smoke monitored space 1 therebetween, and a plurality of light paths 4 are arranged in a lattice form. The paths 4 consist of paths parallelly arranged and paths perpendicular arranged to form the lattice. Each light source 2 is turned on and off sequentially in response to an output from an activating means such as a counter 6 for counting the output of an oscillating circuit 5. Each light detector 3 converts light radiated from the confronting light source 2 into an electric signal. A signal generated at each light detector 3 is converted into a digital signal according to the radiated light through an amplifier 7, a sample hold circuit 8, and an analog/digital converter 9. The converted signal is thereafter sent to a central processing unit (CPU) 10. The CPU 10, based on the signal sent from each light detector 3, calculates a transmittance of the current light compared with the transmittance at the time each path 4 is clear and temporarily stores the calculated transmittance in a storage unit which belongs to the device. Once the transmittances of all of the paths have been calculated in this way, the CPU 10, deeming each intersecting point Of the paths 4 as an imaginary subspace, calculates the transmittance of light at such imaginary subspace on the basis of the measured result of the transmittance of the each path in the same manner as the solution for each element of a matrix is determined. A smoke density of each imaginary subspace can then be calculated from the calculated transmittance of light at each imaginary subspace. The smoke density of each imaginary subspace is compared with an alarm value and if there is any imaginary subspace whose smoke density is greater than this alarm value, such occurrence and location are displayed on a CRT display 11 or the like. In addition to such data, the CRT display 11 displays a smoke density distribution by showing the smoke density at each virtual small space on a plan view covering the entire monitored space so that location of a fire, flow direction of smoke, determination of escape passageways and the like can be facilitated.

Figure 2:
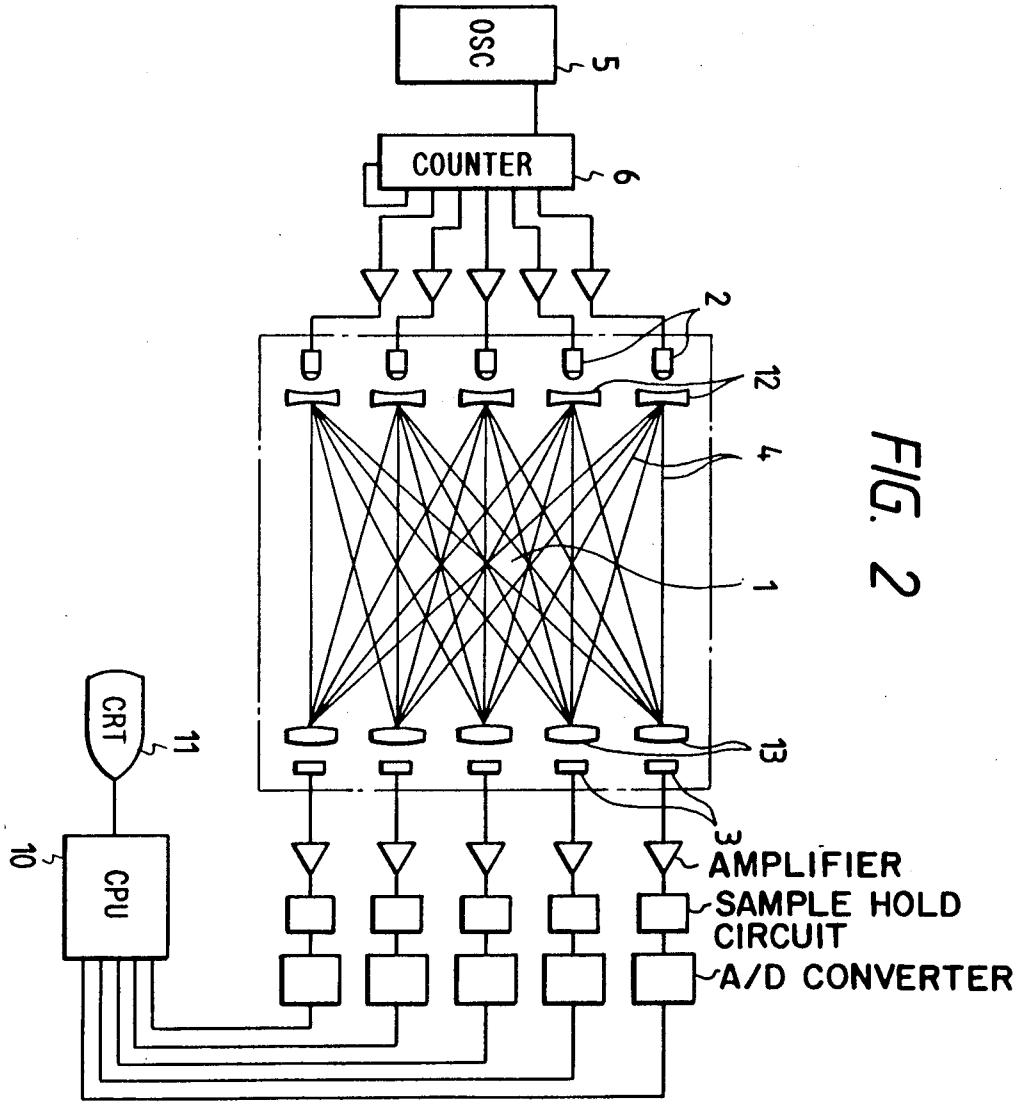
FIG. 2 is a diagram showing the main portion of another exemplary embodiment of a smoke density monitor using the smoke density monitoring system of the invention.

While the above embodiment requires that the pair of light source 2 and light detector 3 be disposed at every path, an embodiment shown in FIG. 2 uses pairs whose number is smaller than the sum of the paths.

FIG. 2 is a diagram showing the main portion of another exemplary embodiment of smoke density monitoring device using the smoke density monitor system of the invention. Similar to the embodiment shown in FIG. 1, the device has a plurality of pairs, each consisting of a group of light sources 2 and a group of light detectors 3 and a smoke monitored space interposed therebetween, and is so constructed that each light source 2 is turned on and off sequentially using an oscillating circuit 5 and a counter 6 and that a signal from the light detector 3 is converted into a digital signal through an amplifier 7, a sample hold circuit 8 and an analog/digital converter 9 and thereafter sent to a CPU 10. In the embodiment shown in FIG. 2, an optical element 12 is disposed in front of each light source 2 and acts as a means to direct a light beam toward a plurality of light detectors so that the light can be radiated to all the light detectors 3 and an optical element 13 is disposed in front of each light detector 3 so that the light radiated from all the light sources 2 can be focused on each light detector.

Figure 3A:
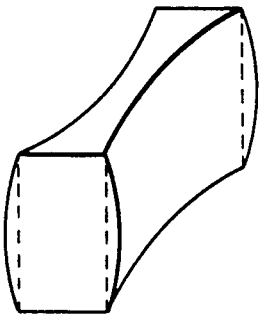
FIGS. 3A and 3B show an appearance of an exemplary optical element used by the embodiment shown in FIG. 2.
Figure 3B:
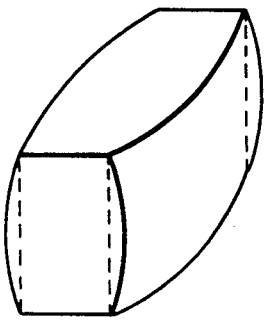

An optical element having such functions and cylindrical lenses as shown in FIG. 3A and 3B are well known.

When each light source 2 is turned on and off in sequence, each light source 2 forms a light path 4 toward each light detector 3. As a result, 25 intersecting paths are formed in this embodiment. The CPU 10, as in the previous embodiment, calculates the transmittance of the current light compared with that at each path 4 when it is clean from a signal sent from each light detector 3 and temporarily stores the calculated transmittance of the current light in a storage unit that belongs to the device. When the transmittances of all the paths have been calculated, the CPU 10 calculates the transmittance of light at each imaginary subspace on the basis of the transmittance of the each path in the same manner as the solution for each element of a matrix is determined. A smoke density at each imaginary subspace is obtained from such calculated transmittance of light.

While this embodiment usually requires that the optical elements be disposed in front of both the light source and light detector, only the optical element in front of the light source may be necessary if a light detector, which is less directional so that light can be detected from a wide range of angles, is employed.

While this embodiment arranges the optical element 12 in front of each light source 2 so that the light can be radiated to all the light detectors 3, each light source and light detector may be arranged on a rotatable stand not only to allow the light to be radiated to all the light detectors but also to allow the light to be detected from all the light sources. However, such an arrangement may become complicated.

As a result of the above construction, any rise in local smoke density at a point in an elongated monitored space can be detected accurately, thereby not only contributing to locating a fire or the like but also allowing a rise in local smoke density in a longitudinally and latitudinally large space. In addition, the display of the smoke density distribution over the imaginary subspaces on the plane view covering the entire monitor space facilitates location of fires, flow direction of smoke, determination of escape passageways and the like.

What is claimed is:

1. A smoke density monitoring system for detecting the presence of smoke within a defined space, said space having first and second sides which are opposite each other, and third and forth sides which are opposite each other, said system comprising:

a first group of light sources positioned along the first side of said space;

a first group of light detectors positioned along said second side of said space for receiving light from said first group of light sources;

a second group of light sources positioned along the third side of said space;

a second group of light detectors positioned along the fourth side of said space for receiving light from said second group of light sources;

the arrangement of said light sources and said light detectors being such to define a plurality of subspaces within said space;

activating means connected to each of said first and second light sources for momentarily activating sequentially each light source so as consequently to actuate a corresponding light detector;

conversion means connected to each of said first and second light detectors for converting a detected light into an electrical signal; and computer means connected to receive the electrical signals from said light detectors and to compare a signal from a particular subspace with a signal received from that subspace when the respective transmittance path was clear and to monitor the smoke density in the subspace being monitored.

2. The system of claim 1 wherein the activating means for the light sources includes an oscillator and a counter.

3. The system of claim 1 wherein the conversion means for the light detectors includes at least one amplifier.

4. The system of claim 1 wherein the conversion means for the light detectors includes at least one analog to digital converter.

5. The system of claim 1 wherein said light sources are positioned to project a plurality of light paths across said space so that said plurality of subspaces are defined in a lattice form.

6. A smoke density monitoring system for detecting the presence of smoke within a space, said space having first and second sides which are opposite each other, said system comprising:

a group of light sources positioned along one of said sides;

a group of light detectors positioned along the other of said sides;

at least one of said light sources having means to direct a light beam toward a plurality of said light detectors and at least one of said light detectors having means to receive a light beam from a plurality of said light sources, the arrangement being such as to project a plurality of light beams crisscrossing said space to divide said space into a plurality of subspaces;

activating means connected to each of said light sources for momentarily activating sequentially each light source so as consequently to activate at least one light detector;

conversion means connected to each said light detector for converting a detected light into an electrical signal; and computer means connected to receive the electrical signals from said light detectors and to compare a signal from a particular subspace with a signal received from that subspace when the respective transmittance path was clear and to monitor the smoke density in the subspace being monitored.

7. The system of claim 6 wherein the activating means for the light sources includes an oscillator and a counter.

8. The system of claim 6 wherein the conversion means for the light detectors includes at least one amplifier.

9. The system of claim 6 wherein the conversion means for the light detectors includes at least one analog to digital converter.

10. The system of claim 6 including a first optical element associated with at least one of said light sources and a second optical element associated with at least one of said light detectors.

11. The system of claim 10 wherein said first and second optical elements are cylindrical lenses.

* * * * *